US005687686A

United States Patent [19]

Takahashi

[11] Patent Number: 5,687,686

[45] Date of Patent: Nov. 18, 1997

[54] LUBRICATING SYSTEM FOR FOUR CYCLE OUTBOARD MOTOR

[75] Inventor: Masanori Takahashi, Hamamatsu, Japan

[73] Assignee: Sanshin Kogyo Kabushiki Kaisha, Hamamatsu, Japan

[21] Appl. No.: 689,301

[22] Filed: Aug. 7, 1996

[30] Foreign Application Priority Data

Aug. 7, 1995 [JP] Japan ..... 7-201201

[51] Int. Cl.[6] ..... F02F 7/00

[52] U.S. Cl. ..... 123/195 P; 123/196 W

[58] Field of Search ..... 123/196 W, 195 P

[56] References Cited

U.S. PATENT DOCUMENTS 5,163,394 11/1992 Koishikawa et al. ..... 123/196 W 5,553,586 9/1996 Koishikawa et al. ..... 123/196 W

*Primary Examiner*—Noah P. Kamen

*Attorney, Agent, or Firm*—Knobbe, Martens, Olson & Bear LLP

[57] ABSTRACT

A four-cycle outboard motor embodying an improved lubricating system. The lubricating system drains oil from the cylinder head back to the oil tank, in a manner so as to not add to the length of the engine. In addition, an improved crankcase ventilating system is employed that incorporates a simple baffle arrangement for ensuring that oil thrown by the crankshaft rotation will not pass through the ventilating passage into the cylinder head or escape from the ventilating system.

18 Claims, 7 Drawing Sheets

LUBRICATING SYSTEM FOR FOUR CYCLE OUTBOARD MOTOR

BACKGROUND OF THE INVENTION

This invention relates to a lubricating system for a four-cycle outboard motor and more particularly to an improved drain and ventilating arrangement for such outboard motors.

For a variety of reasons, there is an increased interest in the utilization of four-cycle engines as the propulsion unit for an outboard motor. This is to replace the more conventionally utilized two-cycle engine. One of the problems attendant with the utilization of four-cycle engines in outboard motors is related to their lubricating system. Although four-cycle engines have an advantage for utilization as the power plant in outboard motors because of their recycling lubricating system, the necessity of maintaining an oil reservoir and the interchange of oil from the reservoir to the engine and back to the reservoir presents some unique problems, particularly in conjunction with outboard motor applications.

Generally, in most engine applications involving four-cycle engines, the crankshaft rotates within a crankcase chamber that is formed at the lower portion of the cylinder bores. Hence, lubricant which is utilized to lubricate the pistons and the valve train mounted in the cylinder head will easily drain by gravity back to the crankcase chamber. The crankcase chamber may, itself, form the oil reservoir for the engine, and such engines are called "wet sump" engines. Alternatively, a drive sump system may be employed where the drained oil is pumped from the crankcase to a separate oil reservoir. However, in either type of system, the gravity drain to the crankcase assists in the oil return.

With outboard motor practice, on the other hand, the engine is normally mounted so that the crankshaft rotates about a vertically disposed axis. Thus, the crankcase chamber cannot practically be utilized as an oil return path. In addition, the draining of oil from the cylinder head back into the retain is also complicated, since the flow from the cylinders must flow along the length of the cylinder head before it can exit. This gives rise to certain problems, which will now be discussed in more detail.

When the cylinder head is disposed so that the cylinder head recesses for each combustion chamber are positioned one above the other, it has been the practice to position the oil drain from the cylinder head at a point below the lowermost diametral extent of the cylinder bore. This actually places the oil drain from the cylinder head below and outside of the cooling jacket for the cylinder head in the cylinder block. As a result, as the bore diameter of the engine becomes larger, the engine length increases disproportionately to the increase in bore dimension. This is obviously undesirable.

It is, therefore, a principal object of this invention to provide an improved oil drain arrangement for a four-cycle outboard motor, wherein the cylinder head can be adequately drained, but the drain passages do not necessitate an increase in the length of the cylinder head and/or engine.

It is a further object of this invention to provide an improved and compact oil drain arrangement for the lubricating system of a four-cycle outboard motor.

Like the oil return, the crankcase ventilating system for outboard motors of the four-cycle type also presents unique problems. Again, the gravity return which assists in conventional orientations for four-cycle engines is not available in two-cycle engines. Furthermore, since the crankshaft rotates about a vertically extending axis, the oil that is thrown from the crankshaft journals can travel horizontally through the ventilating passages that interconnect the crankcase chamber with the cylinder head. This results in the potential entrainment of lubricant in the ventilating gases and possible escape to the atmosphere.

It is, therefore, a still further object of this invention to provide an improved crankcase ventilating system for a four-cycle outboard motor.

It is a further object of this invention to provide an improved baffling system for the crankcase ventilating arrangement for a four-cycle outboard motor.

SUMMARY OF THE INVENTION

A first feature of this invention is adapted to be embodied in an outboard motor that is comprised of a powerhead consisting of a powering internal combustion engine operating on a four-cycle principle and a surrounding protective cowling. The engine has a cylinder block with at least two vertically spaced cylinder bores. A crankshaft is rotatably journaled at one end of the cylinder block about a vertically disposed axis. A cylinder head is affixed to the cylinder block in closing relationship to the ends of the cylinder bores opposite to the crankshaft. The crankshaft is driven by pistons in the cylinder bores. A drive shaft housing and lower unit depends from the powerhead and contains a drive shaft that is also rotatably journaled about a vertically extending axis. This drive shaft is driven by the crankshaft and drives a propulsion device for propelling an associated watercraft. The cylinder block and cylinder head are formed with cooling jackets through which coolant for the engine circulates. An oil tank is disposed below the engine and contains lubricant for the engine. A drain passage is formed in the cylinder head for draining lubricant from the cylinder head back to the oil tank. This drain passage is disposed so that it is positioned at least in part vertically above the lowermost portion of the cylinder head cooling jacket.

Mother feature of the invention is also adapted to be embodied in a four-cycle outboard motor, as described generally in the preceding paragraph. In accordance with this feature of the invention, a plurality of ventilating gas passages interconnect the crankcase chamber with the cylinder head. A baffle plate is affixed across one end of these ventilating passages for assisting in the separation of lubricant from the ventilating air flow from the crankcase chamber to the cylinder head.

DETAILED DESCRIPTION OF THE PREFERRED EMBODIMENTS OF THE INVENTION

Figure 1:
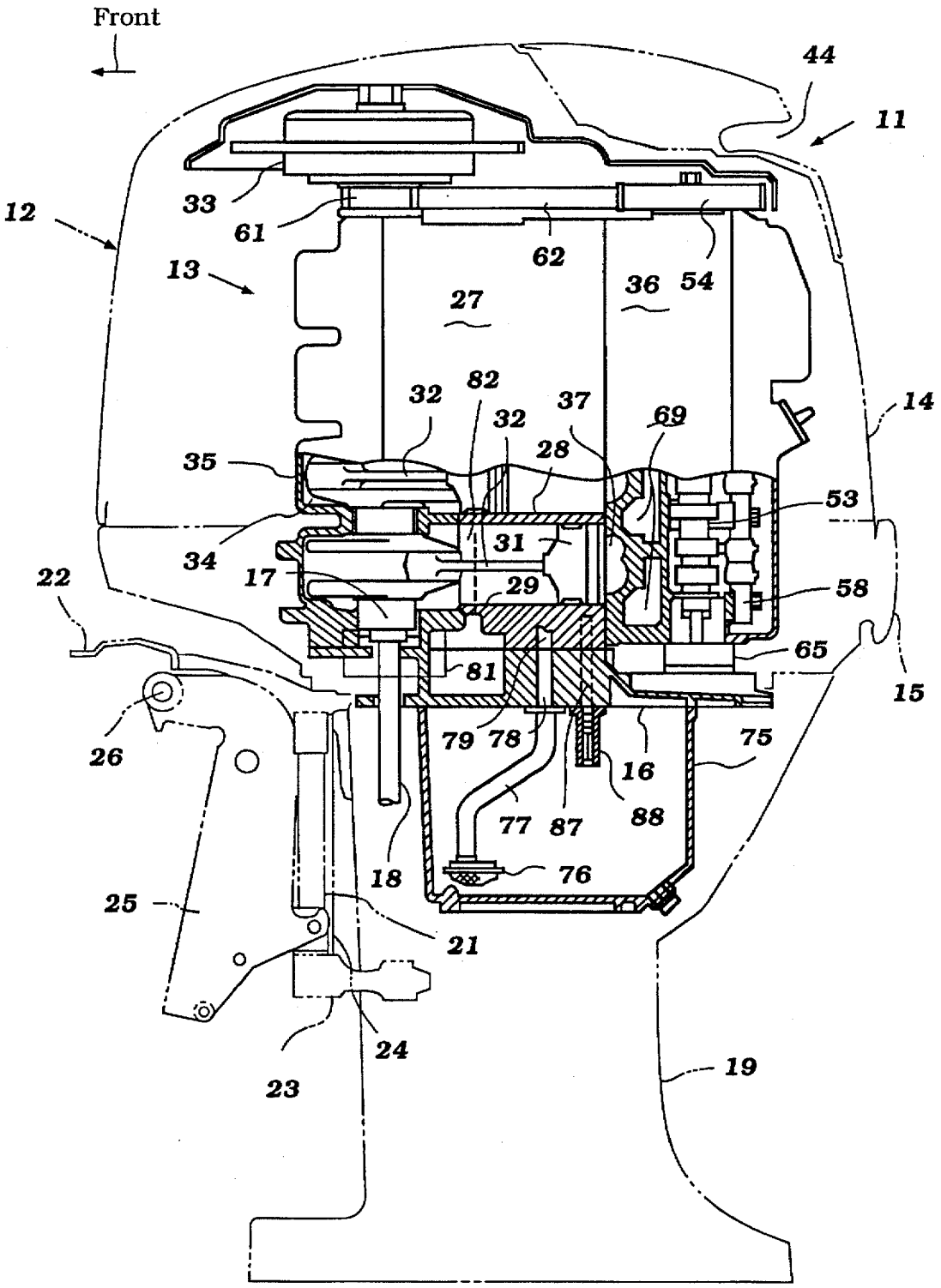
FIG. 1 is a partial side elevational view of the upper portion of an outboard motor constructed in accordance with an embodiment of the invention with the outer housing shown in phantom and with portions of the engine broken away and shown in section to show the lubricating system for the engine.

Referring now to the drawings and initially to FIG. 1, an outboard motor constructed in accordance with an embodiment of the invention is indicated generally by the reference numeral 11. The outboard motor 11 is comprised of a powerhead 12 that includes a powering internal combustion engine 13. The engine 13 is surrounded by a protective cowling that is comprised of a main cowling portion 14 which is detachably connected to a tray portion 15. A guide plate 16 is surrounded by the tray 15 and upon which the engine 13 is mounted in any suitable manner.

As is typical with outboard motor practice, the engine 13 is supported within the powerhead 12 such that its output shaft, a crankshaft indicated by the reference numeral 17, rotates about a vertically extending axis. This crankshaft 17 is rotatably coupled to a drive shaft 18 that rotates about a vertically extending axis and extends through the guide plate 16 and depends into and is journaled within a drive shaft housing and lower unit 19 only the upper portion of which is illustrated because the lower portion thereof is conventional and well known. The tray 15 encircles the upper portion of the drive shaft housing and lower unit 19.

The lower end of the drive shaft 18 is coupled within the drive shaft housing and lower unit 19 to a conventional forward/reverse bevel gear transmission (not shown) which, in turn, is coupled to a propulsion device (not shown) such as, for example, a propeller for driving the propeller in selected forward or reverse directions so as to so propel an associated watercraft (not shown).

A steering shaft 21 having a tiller 22 affixed to its upper ends is affixed in a suitable manner by means which include a lower bracket assembly 23 to the drive shaft housing and lower unit 19. This steering shaft 21 is journaled within a swivel bracket 24 for steering of the outboard motor 11 about a vertically extending axis defined by the steering shaft 22. The swivel bracket 24 is, in rum, connected to a clamping bracket 25 by means of a trim pin 26. This pivotal connection permits tilt and trim motion of the outboard motor 11 relative to the transom of the watercraft powered by the outboard motor 11.

Figure 2:
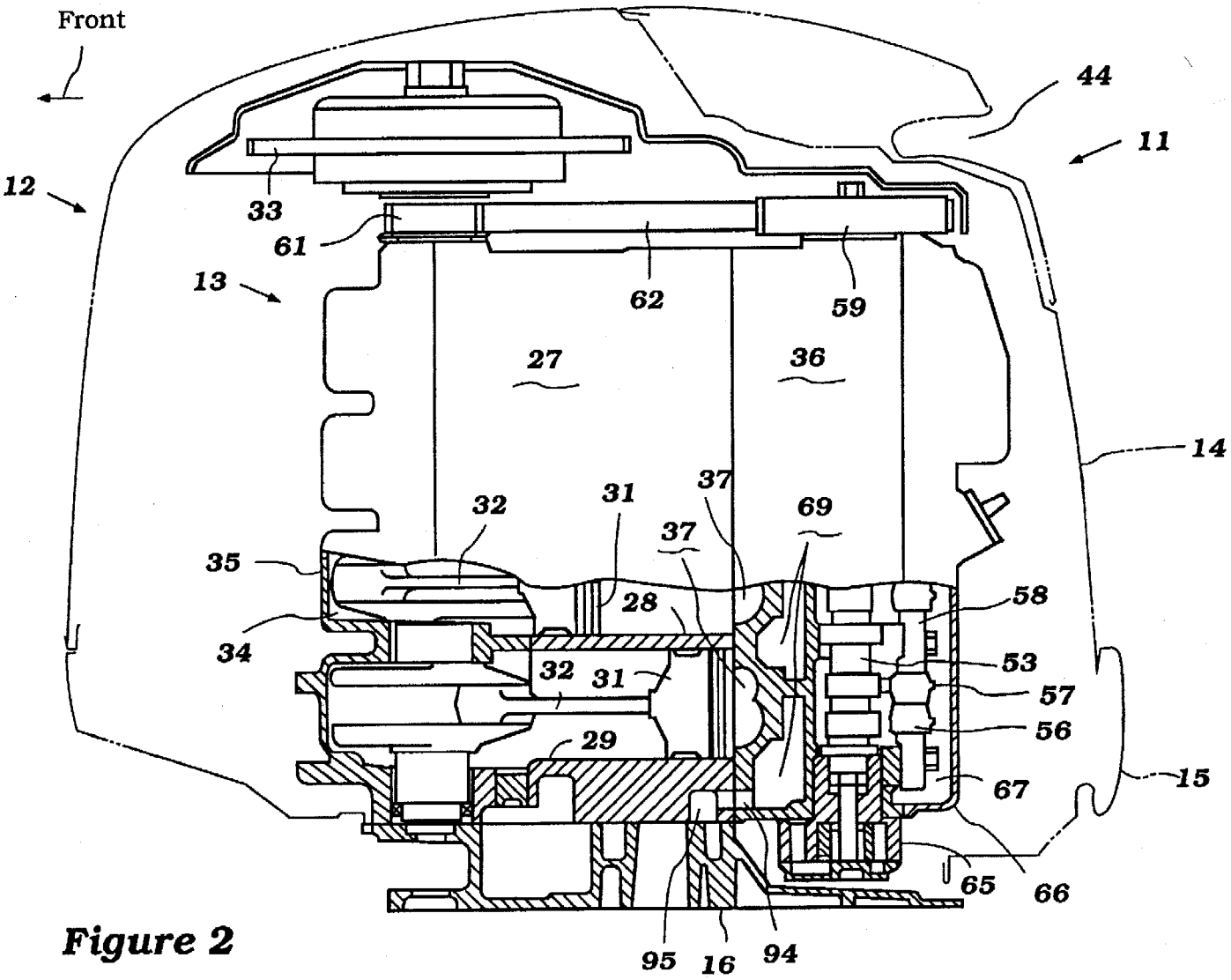
FIG. 2 is an enlarged side elevational view of the power head of the outboard motor of FIG. 1 with the same portions broken away and shown in section.

The engine 13 will now be described in detail with additional reference to FIGS. 2 and 3. The engine 13 is in the illustrated embodiment of the four-stroke, four-cylinder, inline type of configuration. To this end, the engine 13 is provided with a cylinder block 27 in which four horizontally extending parallel openings are formed in a vertically spaced relationship with each other. Press fit sleeves 28 are received in these openings and define cylinder bores 29 in which pistons 31 reciprocate. The longitudinally axes of the cylinder bores 29 define a vertical plane in which the pistons 31 reciprocate. Although the invention is described in conjunction with the four-cylinder inline engine, it will be readily apparent to those skilled in the art how the invention may be utilized with engines having various cylinder numbers and cylinder configurations.

The pistons 31 are pivotally connected to the small ends of respective connecting rods 32 whose big ends are rotatably journaled about the throws of the crankshaft 17. A flywheel 33 is affixed to the upper end of the crankshaft 17. The crankshaft 17 is rotatably journaled about a vertically extending axis by any suitable means within a crankcase 34 which is defined by the forwardly facing end of the cylinder block 27 and the crankcase member 35 which is affixed to the front face of the cylinder block 27 by any suitable means.

A cylinder head is indicated by the reference numeral 36 and is affixed to the rearward facing end of the cylinder block 27 in a known manner. The cylinder head 36 has individual recesses 37 that cooperate with the cylinder bores 29 and pistons 31 to define the engine combustion chambers. An intake valve 38 is slidably supported in the cylinder head 36 for each combustion chamber 37 and controls an intake port 39 that cooperates with the inner end of an intake passage 41 formed in the cylinder head 36. The outer end of the intake passage 41 terminates at an induction and charge formed system that is indicated generally by the reference numeral 42 and includes an air box 43.

The air box 43 receives a supply of atmospheric air through an opening 44 formed in the upper end of the main cowling 14 and delivers the air through an intake manifold 45 to a carburetor 46. The carburetor 46 mixes the air with a supply of fuel from a fuel tank (not shown) suitably positioned within the hull of the associated watercraft in a ratio that is suitable for combustion. This air fuel charge is then delivered to the combustion chamber 37 through the intake passage 41. The amount of air fuel charge delivered to the combustion chamber 37 is regulated by a throttle valve (not shown) that is disposed within the carburetor 46.

An exhaust valve 47 is slidably supported in the cylinder head 36 for each of the combustion chambers 37 and controls the flow of the exhaust gases from the combustion chamber 37 through an exhaust port 48 and into an exhaust passage 49. The exhaust passage 49 terminates at the surface of the cylinder head 36 that faces the cylinder block 27 and cooperates with an exhaust discharge passage 51 which is integrally formed within the cylinder block 27 and opens to an exhaust manifold 52 that is also integrally formed within the cylinder block 27.

From the exhaust manifold 52, the exhaust gases are discharged and silenced through an exhaust system (not shown) from the outboard motor 11 to the atmosphere through the body of water in which the watercraft is operating in a manner that is well known in the art.

A single overhead camshaft is indicated by the reference numeral 53 and is rotatably journaled within the cylinder head 36 between the intake and exhaust valves 38 and 47. The camshaft 53 is provided with intake and exhaust cam lobes 54 and 55, respectively, that operate on intake and exhaust rocker arms 56 and 57, respectively, which are rotatably journaled upon a rocker arm shaft 58. The rocker arm shaft 58 is mounted within the cylinder head 36 above of and extending parallel to the camshaft 53. The outer ends of the intake and exhaust rocker arms 56 and 57 operate on the tips of the intake and exhaust valves 38 and 47.

A camshaft pulley 59 is affixed to the upper end of the camshaft 53 and is driven by a crankshaft pulley 61 that is affixed to the upper end of the crankshaft 17 beneath the flywheel 33 through a timing drive belt 62. As is well known in the art, the camshaft 53 is driven by the crankshaft 17 at one-half crankshaft speed which is accomplished by a two to one reduction of the camshaft pulley 59 relative to the crankshaft pulley 61. Thus, the intake and exhaust valves 38 and 47 are opened at the appropriate times by their associated cam lobes 54 and 55 by the crank driven camshaft 53 through the rocker arms 56 and 57. Additionally, intake and exhaust valve return spring 63 and 64 are associated with the valves 38 and 47, respectively, and serve to close the valves 38 and 47.

A positive displacement gear-type oil pump 65 is affixed to and driven by the lower end of the camshaft 53 and comprises a component of the lubricating system of the engine 13 which will be discussed in detail later.

The end of the cylinder head 36 opposite the cylinder block 27 forms a cam chamber that contains the valves 34 and 48 and their actuating mechanism. This cam chamber is sealed by a cover 66 that is affixed to the cylinder head 36 by any suitable means. An oil separator chamber 67 is included within the cover 66 and defined by the upper end of the cover 66 and a strainer plate 68 (FIG. 4) and cooperates with an engine ventilation system that will be discussed in detail later.

The engine 13 is water cooled. For this reason, a cooling jackets or water jackets 69 are disposed in close proximity to the cylinder bores 29 in both the cylinder block 27 and cylinder head 36. These cooling jackets 69 receive a supply of cooling water from the body of water in which the watercraft is operating in a manner that is well known in the art for cooling of the engine 13.

Figure 3:
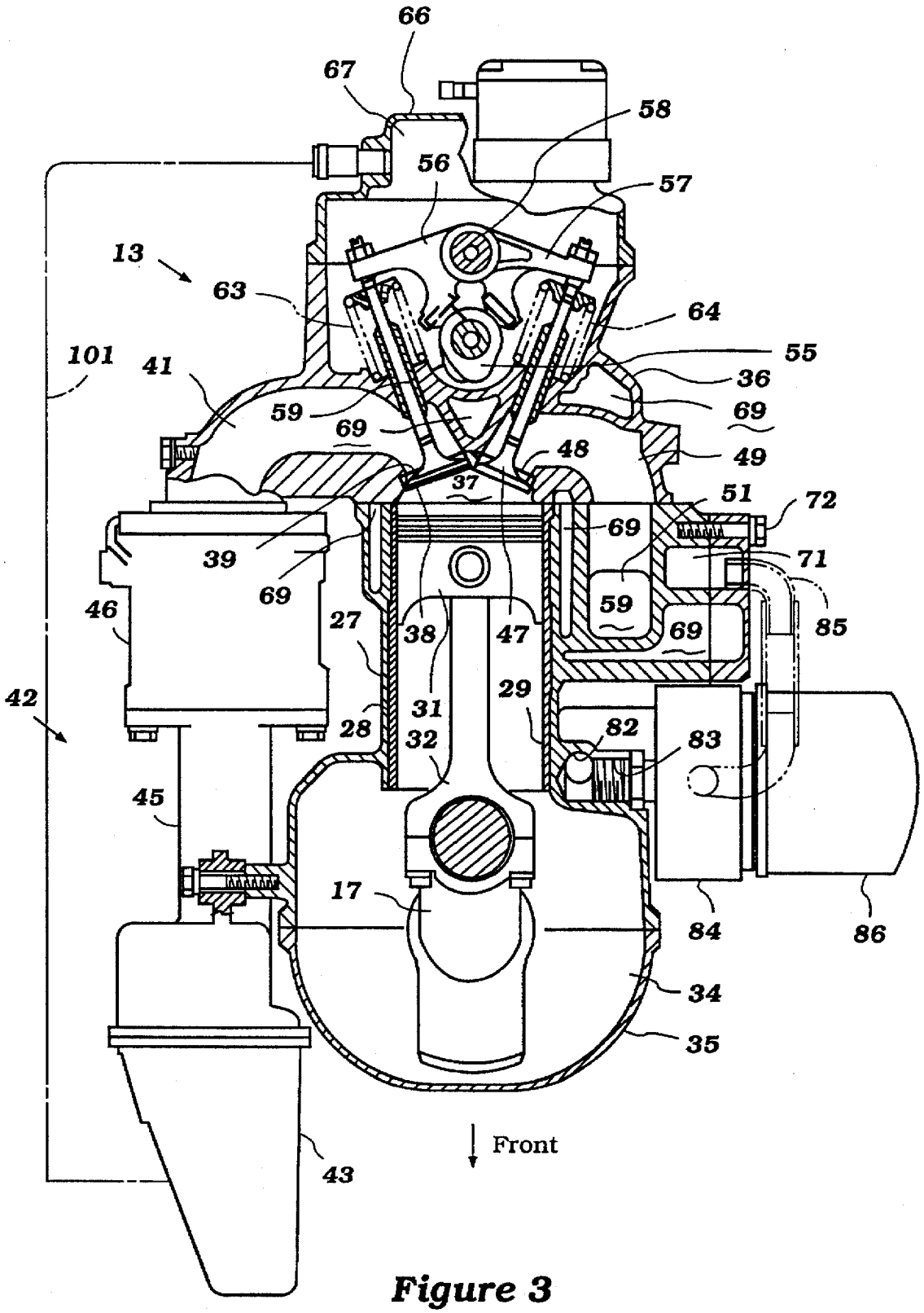
FIG. 3 is a top plan view of the engine with portions broken away and other portions shown in section to illustrate various internal components of the internal combustion engine.

As seen in FIG. 3, some of the water jackets 69 are formed by the cooperation of the outer surface of the cylinder block 27 with a cooling plate 71 which is affixed to the exhaust side of the cylinder block 27 by means of a bolt 72 and used to cool the exhaust gasses. One of these water jackets 69 will also be used in the cooling of the engine lubricant in a manner which will be discussed in detail later.

Figure 4:
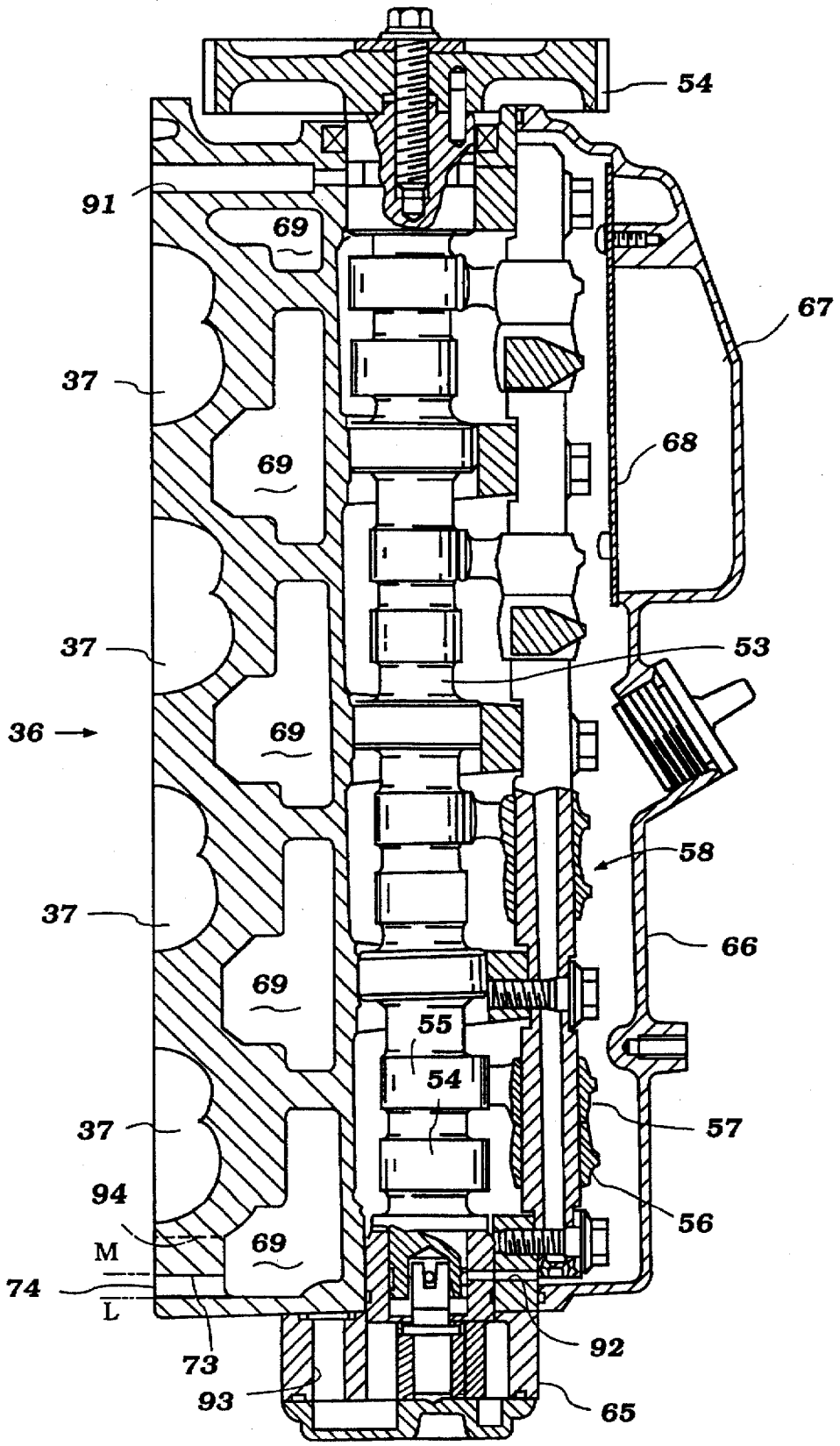
FIG. 4 is a cross-sectional view of the cylinder head and shows a portion of the lubricating system for the engine.
Figure 5:
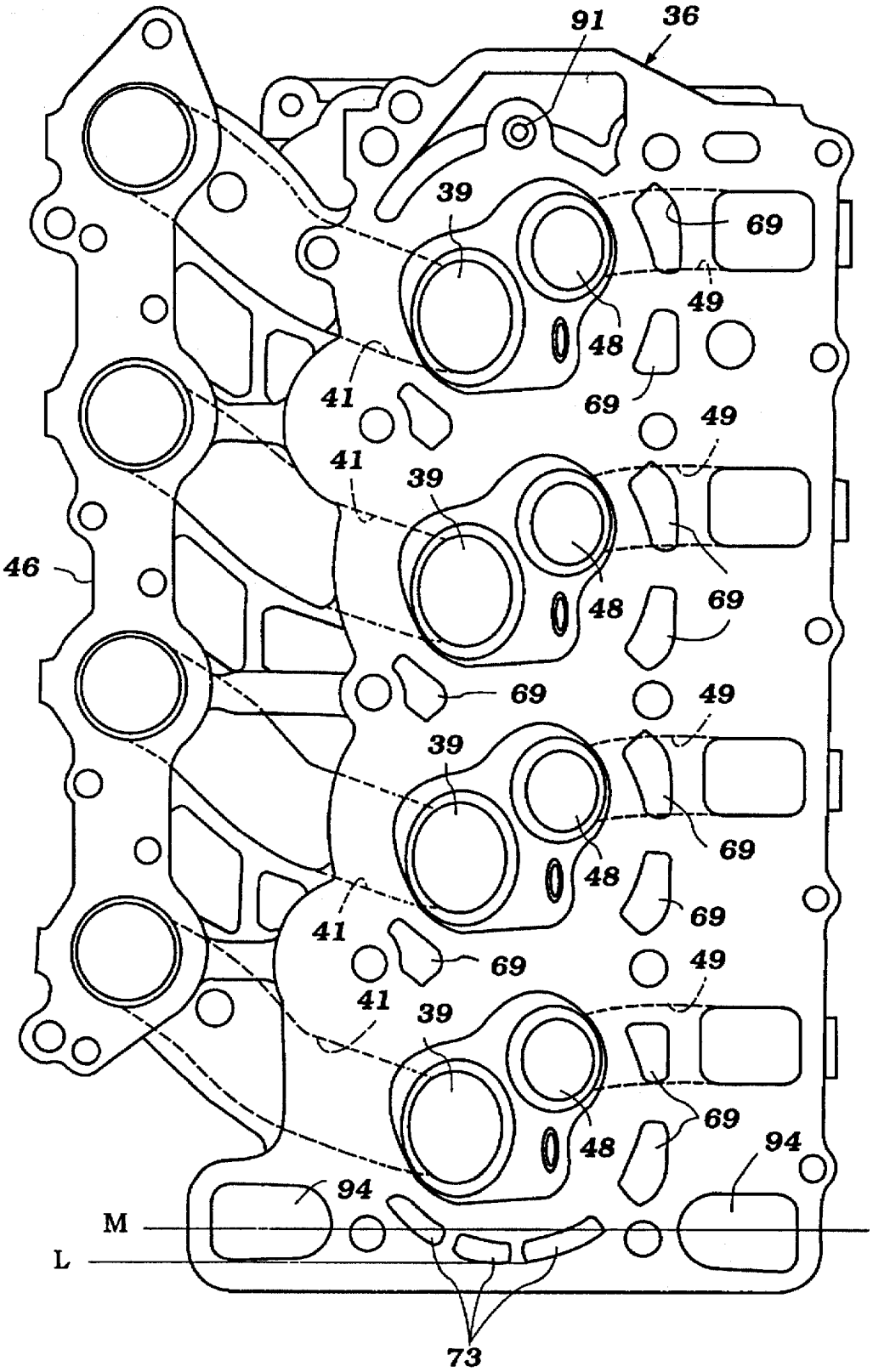
FIG. 5 is a bottom plan view of the cylinder head and shows the cooling and lubricant draining arrangements.

With reference now to FIGS. 4 and 5, a trio of water return passages are indicated by the reference numeral 73 and formed, in part, around the lower portion of the lowermost cylinder head recess 37. The water return passages 73 include water return openings 74 through which the water in the cylinder head cooling jackets 69 drain from the cylinder head 36 into the water return passages 73 integrally formed in the cylinder block 27 which routes the water to the exhaust system of the outboard motor 11 for discharge to the body of water in which the watercraft is operating.

The lubricating system for the engine 13 will now be discussed in detail. The engine 13 is lubricated by a lubricating system that maintains the proper near frictionless operation of the engine's moving parts, such as the crankshaft 17, camshaft 53 and pistons 31. With reference now to FIGS. 1 and 3, the lubricating system includes an oil tank 75 that is disposed within the drive shaft housing and lower unit 19 vertically beneath the engine 13 and is affixed to the guide plate 16 by any suitable means. A strainer 76 is positioned within the lower end of the oil tank 75 and delivers oil to the lower end of an oil conduit 77.

The upper end of the oil conduit 77 opens to an oil passage 78 that is integrally formed in and extends through the guide plate 16. The oil passage 78, in turn, connects to an oil supply passage 79 that is integrally formed within the lower face of the cylinder block 27 and supplies oil to the cam shaft driven oil pump 65. Alternatively the cam shaft driven oil pump 65 may be replaced by a crankshaft driven, positive displacement, gear-type oil pump 81 that is positioned at the lower end of the cylinder block 27 in close proximity to the oil tank 75 and driven off of the lower end of the crankshaft 17.

Whichever oil pump is employed, it pumps the oil throughout the engine 13 through a main gallery 82 that is integrally formed within the lower face of the cylinder block 27 and includes a threaded opening 83 that is surrounded by an oil cooler 84 located on an external side of the engine 13 in proximity to the crankcase 34. Oil from delivery passage 82 is cooled by the oil cooler 84 which is supplied from coolant from one of the water jackets 69 defined by the cooperation of the side of the cylinder block 27 and the cooling plate 71 through an external coolant pipe 85.

From the oil cooler 84, the oil enters an oil filter 86 which threadingly engages the outer surface of the oil cooler 84 where it is filtered before returning to the main gallery 82 for circulation throughout the engine 13. The main gallery 82 includes a pressure relief passage 87 which opens to and receives a supply of oil from the main gallery 82. This pressure relief passage 87 is integrally formed within the lower face of the cylinder block 27 and also extends downwardly through the guide plate 16 and terminates at a pressure relief valve 88 that is located in the oil tank and affixed to the lower surface of the guide plate 16 by any suitable means. The pressure relief valve 88 controls the pressure of the oil circulated throughout the engine 13 by returning excess oil to the oil tank 75 when the oil pressure in the main gallery 82 and pressure relief passage 72 exceeds the desired value.

The main gallery 82 extends upwardly through the cylinder block 27 and delivers oil to the crankshaft 17 through a delivery passage 89 (FIG.) 6 for lubrication of the crankshaft 17, pistons 31 and cylinder bores 29. This oil then drains through the cylinder block 27 to the oil tank 75 for recirculation in a manner that is well known in the art.

The main gallery 82 also delivers oil to a cylinder head delivery passage (not shown) for supplying the camshaft 53, rocker arm shaft 58, rocker arms 56 and 57 and valves 38 and 47 with lubricating oil. This oil drains downwardly through the cylinder head 36 into the cylinder block 27 and is returned to the oil tank 75 for recirculation.

A problem exist however, in the manner by which the oil is drained from the cylinder head 36 into the cylinder block 27. It is the conventional practice to place the oil drain passages for the cylinder head below the lowermost diametral extent of the cylinder bore which effectively places the oil drain passage below and outside of the cooling jackets for the cylinder head in the cylinder block. This results in an increase in the overall length of the engine. This invention eliminates this increase in length by disposing the oil drain passages within the cylinder block in a manner that in no way adds to the length of the engine.

With reference now to FIGS. 4 and 5, a cylinder head oil passage is integrally formed within the upper end of the cylinder head 36 and indicated by the reference numeral 91. The oil inlet passage 91 delivers oil to the main gallery 82 if the camshaft driven oil pump 65 is used or receives a supply of lubricating oil from the main gallery 82 through the cylinder head delivery passage if the crankshaft driven oil pump 81 is employed. In the former case oil is delivered from the pump 65 through an oil passage 92 to the rocker arm shaft 58 and then delivers this oil to the camshaft 53 for lubricating the camshaft 53, rocker arm shaft 58, rocker arms 56 and 57 and valves 38 and 47. In either event the excess oil then drains downwardly to the lower end of the cylinder head 36.

The oil is returned to the oil tank 75 through a pair of oil drain passages 94 that are integrally formed within the lower end of the cylinder head 36 and disposed symmetrically about the vertical plane defined by the axis of the cylinder bores 29. The oil drain passages 94 are positioned transversely outwardly from the water return passages 73 with the mid points of the oil drain passages 94 being disposed along the line M above the line L, which indicates the lowermost extension of the cooling jackets 69 and water return passages 73.

As best seen in FIG. 5, the lowermost ends of the oil drain passages 94 do not extend below the line L. Thus, the drain passages 94 do not add to the length of the cylinder head 36. From the oil drain passages 94 the oil is delivered to an oil return passage 95, (FIG. 2) which returns the oil to the oil tank 75 for recirculation in a manner that is well known in the art. Thus, the above-described lubricating system provides for the recirculation of the oil in a manner that in no way adds to the length of the engine 13.

The ventilating system for the engine 13 will now be described in detail. A crank case ventilating systems for the recirculation of blow-by gasses to the induction system which returns the blow-by gasses to the combustion chambers for ignition is incorporated so as to reduce the emission of harmful hydrocarbons present in the blow-by gas to the atmosphere. These ventilating systems typically include a plurality of ventilating passages which open to the crankcase and extend along upwardly generally parallel to the longitudinal axis of the cylinder bores to the cylinder head for engines whose crankshafts are rotatably journaled about a horizontal axis.

A problem exists with this arrangement, however, for engines who crankshafts are rotatably journaled about a vertical axis in that the ventilating passages extend horizontally through the cylinder block and it is possible for oil to drain into the ventilating passages and eventually out of the engine through the exhaust system. This invention minimizes this undesirable situation by providing a means by which the flow of oil through the ventilating passages is inhibited.

Figure 6:
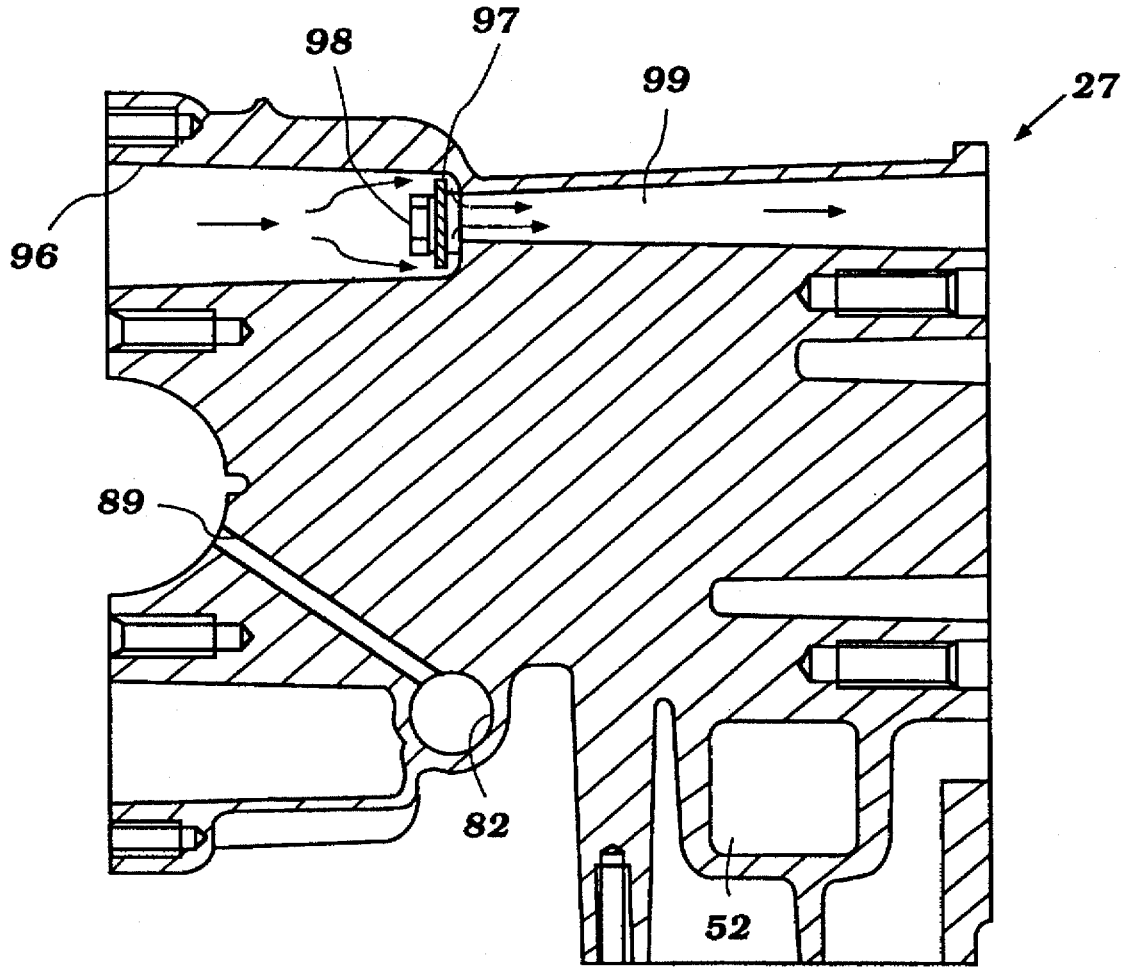
FIG. 6 is a cross-sectional view of the cylinder block of the outboard motor and shows the ventilating system arrangement for the engine.
Figure 7:
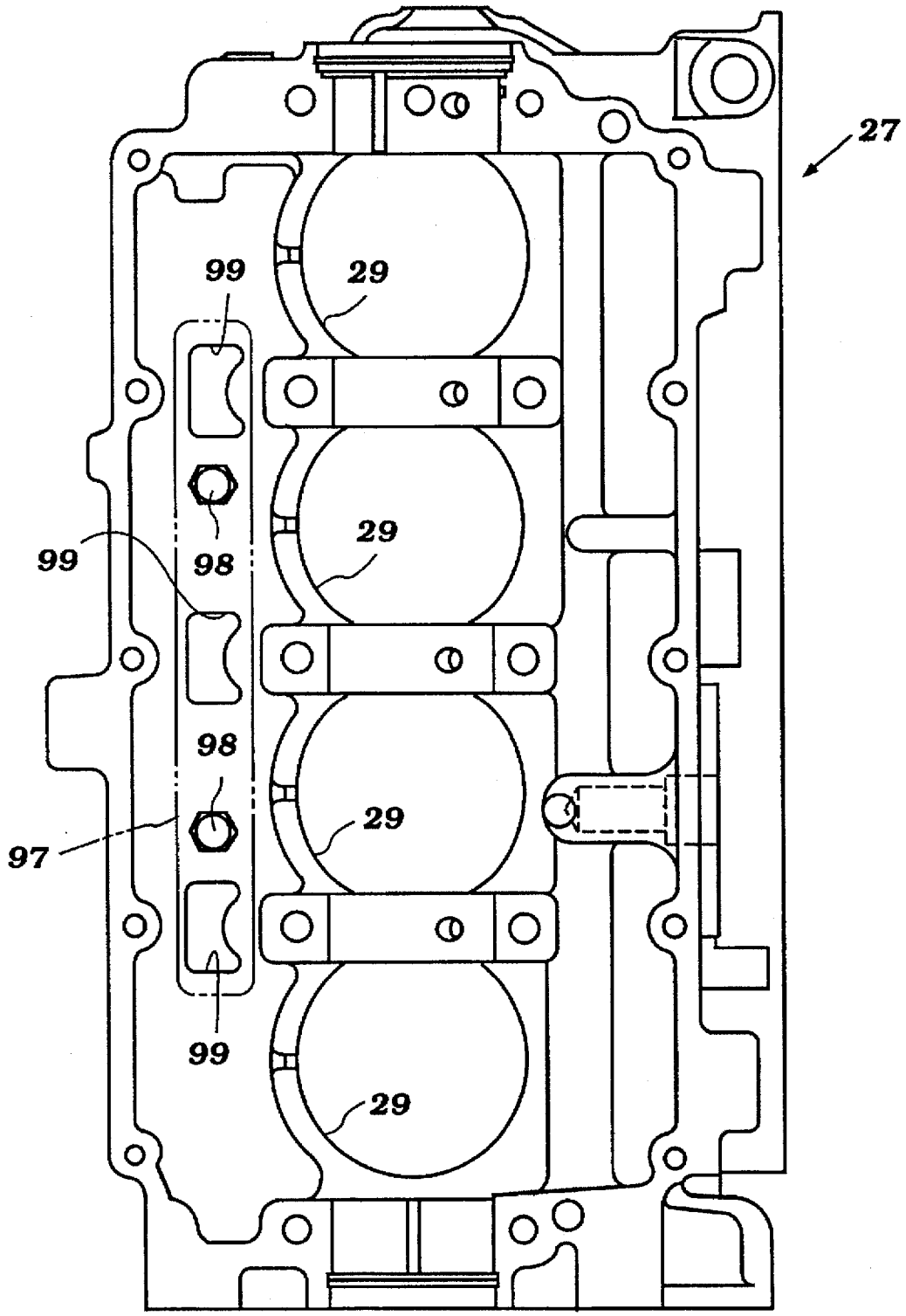
FIG. 7 is a bottom plan view of the cylinder block of the outboard motor with the crankshaft removed.

With reference now to FIGS. 3, 6 and 7, a ventilating system inlet is indicated by the reference numeral 96 and integrally formed within the forward end of the cylinder block 27. The inlet 96 opens at its forward end to the crankcase 34 and extends horizontally into the cylinder block 27. A baffle plate 97 is affixed to the rearward end of the inlet 96 by bolts 98 in close proximity to the forward end of a trio of ventilating system delivery passages 99 which open to the inlet 96 and extend rearwardly and open at their rearward ends to the cylinder head 36.

Oil entering the ventilating system inlet 96 is precluded from passing through the delivery passages 99 to the cylinder head 36 by the baffle plate 97 which prevents the oil from proceeding through the ventilating system delivery passage 99 while the blow-by gas readily flows about the baffle plate 97 through the delivery passage 99 and into the cylinder head 36. The blow-by gas then enters the oil separator chamber 67 past the strainer 68, which prevents oil in the cylinder head 36 from entering the oil separator chamber 67, where it is returned to the air box 43 through a return conduit 101 for delivery to the combustion chambers 37. Thus, the above arrangement inhibits the flow of oil through the ventilating system to the cylinder head while still permitting the flow of blow-by gasses.

From the foregoing, it should be readily apparent that the above invention provides a lubricating system that in no way adds to the length of the engine and a ventilating system that precludes the flow of oil from the lubricating system through the ventilation system and out into the atmosphere. Of course, the foregoing description is that of preferred embodiments of the invention, and various changes and modifications may be made without departing from the spirit and scope of the invention, as defined by the appended claims.

What is claimed is:

1. An outboard motor comprised of a powerhead consisting of a four-cycle internal combustion engine and a surrounding protective cowling, said engine being comprised of a cylinder block having at least two vertically spaced cylinder bores, the axes of all of said cylinder bores all lying in a common vertical plane, a crankcase chamber formed at one end of said cylinder bores and containing a crankshaft rotatably journaled about a vertically extending axis, a drive shaft housing and lower unit depending from said powerhead and containing a drive shaft rotatable about a vertically extending axis and driven by said crankshaft, said crankshaft being driven by pistons reciprocating in said cylinder bores, a cylinder head affixed to said cylinder block and in closing relationship to the ends of cylinder bores opposed from said crankcase chamber, said cylinder block and said cylinder head having a cooling jacket through which liquid coolant is circulated, an oil tank for said engine disposed vertically beneath said engine, and a drain passage for draining lubricant from said cylinder head to said oil tank through said cylinder block, said drain passage being disposed vertically above the lowermost portion of said cylinder head cooling jacket.

2. The outboard motor of claim 1, further including a plurality of water return passages extending between the cylinder head and the cylinder block.

3. The outboard motor of claim 2, wherein the water return passages in the cylinder head are formed at least in part around the lower portion of the lowermost cylinder head recess cooperating with the lowermost cylinder bore.

4. The outboard motor of claim 1, wherein the oil drain from the cylinder head is offset to one side of a vertical plane containing the axes of the cylinder bores.

5. The outboard motor of claim 1, further including a plurality of ventilating passages extending through the cylinder block from the crankcase chamber to the cylinder head in vertically spaced relationship to each other for conveying ventilating gases between the cylinder block and the cylinder head.

6. An outboard motor comprised of a powerhead consisting of a four-cycle internal combustion engine and a surrounding protective cowling, said engine being comprised of a cylinder block having at least two vertically spaced cylinder bores, a crankcase chamber formed at one end of said cylinder bores and containing a crankshaft rotatably journaled about a vertically extending axis, a drive shaft housing and lower unit depending from said powerhead and containing a drive shaft rotatable about a vertically extending axis and driven by said crankshaft, said crankshaft being driven by pistons reciprocating in said cylinder bores, a cylinder head affixed to said cylinder block and in closing relationship to the ends of cylinder bores opposed from said crankcase chamber, said cylinder block and said cylinder head having a cooling jacket through which liquid coolant is circulated, an oil tank for said engine disposed vertically beneath said engine, and a pair of oil drain passages for draining lubricant from said cylinder head to said oil tank through said cylinder block, said oil drain passages being disposed vertically above the lowermost portion of said cylinder head cooling jacket, each of said oil drain passages being offset to one side of a vertical plane containing the axes of the cylinder bores, each oil drain passage being disposed on an opposite side of said vertical plane.

7. The outboard motor of claim 6, further including a plurality of water return passages extending between the cylinder head and the cylinder block.

8. The outboard motor of claim 7, wherein the water return passages in the cylinder head are formed at least in part around the lower portion of the lowermost cylinder head recess cooperating with the lowermost cylinder bore.

9. The outboard motor of claim 8, wherein the oil drains are disposed transversely outwardly from the water return openings.

10. An outboard motor comprised of a powerhead consisting of a four-cycle internal combustion engine and a surrounding protective cowling, said engine being comprised of a cylinder block having at least two vertically spaced cylinder bores, a crankcase chamber formed at one end of said cylinder bores and containing a crankshaft rotatably journaled about a vertically extending axis, a drive shaft housing and lower unit depending from said powerhead and containing a drive shaft rotatable about a vertically extending axis and driven by said crankshaft, said crankshaft being driven by pistons reciprocating in said cylinder bores, a cylinder head affixed to said cylinder block and in closing relationship to the ends of cylinder bores opposed from said crankcase chamber, said cylinder block and said cylinder head having a cooling jacket through which liquid coolant is circulated, an oil tank for said engine disposed vertically beneath said engine, an oil drain passage for draining lubricant from said cylinder head to said oil tank through said cylinder block, said oil drain passage being disposed vertically above the lowermost portion of said cylinder head cooling jacket, a plurality of ventilating passages extending through said cylinder block from said crankcase chamber to said cylinder head in vertically spaced relationship to each other for conveying ventilating gases between said cylinder block and said cylinder head, and a baffle plate extending across the openings of said ventilating passages for separating lubricant from the ventilating air.

11. The outboard motor of claim 10, wherein the baffle plate is fixed at the crankcase end of the ventilating passages.

12. The outboard motor of claim 11, further including a plurality of water return passages extending between the cylinder head and the cylinder block.

13. The outboard motor of claim 12, wherein the water return passages in the cylinder head are formed at least in part around the lower portion of the lowermost cylinder head recess cooperating with the lowermost cylinder bore.

14. The outboard motor of claim 11, wherein the oil drain from the cylinder head is offset to one side of a vertical plane containing the axes of the cylinder bores.

15. The outboard motor of claim 14, wherein there are a pair of oil drains, each disposed on an opposite side of the vertical plane.

16. The outboard motor of claim 15, further including a plurality of water return passages extending between the cylinder head and the cylinder block.

17. The outboard motor of claim 16, wherein the water return passages in the cylinder head are formed at least in part around the lower portion of the lowermost cylinder head recess cooperating with the lowermost cylinder bore.

18. The outboard motor of claim 17, wherein the oil drains are disposed transversely outwardly from the water return openings.

* * * * *